US005337481A

United States Patent [19]

Mears

[11] Patent Number: 5,337,481

[45] Date of Patent: Aug. 16, 1994

[54] DUAL BLADE UTILITY KNIFE

[76] Inventor: Michael G. Mears, 1409 35th St. West, Bradenton, Fla. 34205

[21] Appl. No.: 37,977

[22] Filed: Mar. 29, 1993

[51] Int. Cl.[5] ..... B26B 1/08

[52] U.S. Cl. ..... 30/162; 30/335

[58] Field of Search ..... 30/162, 151, 152, 329, 30/335

[56] References Cited

U.S. PATENT DOCUMENTS

| | | | |
|---|---|---|---|
| 2,736,960 | 3/1956 | Armstrong | 30/162 |
| 3,651,571 | 3/1972 | Neale | 30/162 |
| 4,509,260 | 4/1985 | Gringer | 30/335 |
| 4,578,865 | 4/1986 | Keller | 30/162 |
| 5,099,578 | 3/1992 | Jan | 30/335 |
| 5,203,086 | 4/1993 | Dann | 30/294 |
| 5,230,152 | 7/1993 | Kennedy | 30/162 |

FOREIGN PATENT DOCUMENTS

| | | | |
|---|---|---|---|
| 23843 | of 1895 | United Kingdom | 30/162 |

*Primary Examiner*—Richard K. Siedel
*Assistant Examiner*—Hwei-Siu Payer
*Attorney, Agent, or Firm*—Dominik, Stein, Saccocio, Reese, Colitz & Van Der Wall

[57] ABSTRACT

A utility knife comprising, in combination, a handle having a first handle portion and a second handle portion and coupling means to releasably join together the handle portions so as to be readily grasped by an operator during use, a central plane extending longitudinally through the handle and defining on opposite sides thereof a first blade-receiving chamber in the first handle portion for receiving a first blade holder and a second blade-receiving chamber in the second handle portion for receiving a second blade holder; and a first blade holder located in the first handle portion for supporting a first blade and a second blade holder located in the second handle portion for supporting a second blade, the blade holders being independently reciprocable in planes parallel with the central plane but on opposite sides thereof, each blade holder having an individual actuator extending to exterior of the handle whereby an operator may move either blade holder or both between a retracted inoperative orientation with an associated blade totally within the handle and an extended operative orientation with an associated blade partially exterior of the handle.

10 Claims, 5 Drawing Sheets

DUAL BLADE UTILITY KNIFE

BACKGROUND OF THE INVENTION

This invention relates to a dual blade utility knife and, more particularly, to utility knives with a handle and a pair of blades independently reciprocable in parallel planes between interior inoperative orientations and exterior operative orientations.

DESCRIPTION OF THE BACKGROUND ART

Many types of knives are used today throughout the world. Such knives are of various sizes and shapes for particular applications. One common knife is the utility knife. The utility knife has a wide variety of functions including the roofing trade, the floor covering trade, and the like.

Utility knives normally include a handle separable into two halves along the plane of the central blade. Separation of the halves allows for the addition of a blade or its removal from the handle. Separation also allows for the replacement of one style of blade with another. Variations in the utility knife include mechanisms for allowing a blade to be advanced to an operative position outside the handle or retracted to an inoperative position interior of the handle. Another variation includes blade movement from opposite ends of the handle.

No known utility knife, however, allows for plural blades of a common or different design to be moved between interior and exterior positions from one end of the handle. As a result, when users of utility knives are at a location with a first utility knife and find the need for a utility knife with a different blade, the making of the change of blades can be a difficult proposition requiring manual dexterity and both hands. Consequently, a utility knife having the capability of two independently actuable blades movable in parallel planes from the same side of the knife would add convenience and economy to workers who use utility knives either on a regular or casual basis.

Typical examples of utility knives are described in the patent literature. Such utility knives are described in U.S. Pat. No. 3,906,627 to Manning; U.S. Pat. No. 4,517,741 to Castelluzzo; U.S. Pat. No. 4,578,865 to Keller; and U.S. Pat. No. 5,093,994 to Karas. The patent to Manning relates to a utility knife with a single blade which may be pushed forwardly by a projection but is spring urged to the interior safe position when the projection is released. The Castelluzzo patent relates to a handle with a stack of blades and includes a slide with a magnet for engaging and sliding one of the blade to the extended position and for retracting the blade into the handle along with locking the blade. The Keller patent relates to a utility knife with a projection adapted to advance a pair of blades between the internal retracted position and the external operative position with mechanisms coupling the blades to a single projection for concurrent advancement and for retraction. The patent to Karas discloses a utility knife with two blades in a common plane of operation wherein the blades may be advanced from one end of the handle or the other.

Earlier patents to knives wherein multiple blades are used with a common handle include the patent to Garda, U.S. Pat. No. 719,208. According to Garda, a plurality of blades and a fork are located in a common handle assembly with portions pivotable toward and away from each other to allow exposing the knives and/or forks for use. A later patent to van Sickel, U.S. Pat. No. 1,599,800, discloses a stencil knife and blade holder. According to that disclosure, parallel blades extend from one end of a handle which functions as the blade holder. Adjustments may be used to modify the extent of exposure of the blade. Lastly, the patent to Schierstead, U.S. Pat. No. 2,604,693, relates to a dental finishing tool, not necessarily a knife, wherein two blades are supported in a handle with each blade having an upturned edge for advancing or retracting the edge between operative and inoperative positions. The blades and the movement are not parallel with respect to each other but angle inwardly toward the common central plane of the handle.

As can be understood, a wide variety of advances has been made in knives. None, however, features a utility knife with a pair of blades, each independently reciprocable in parallel planes between interior inoperative orientations and exterior operative orientations to extend the utility of such knives and to allow them to be used in a safe, convenient and economic manner.

Accordingly, it is an object of the present invention to provide an improved utility knife comprising, in combination, a handle having a first handle portion and a second handle portion and coupling means to releasably join together the handle portions so as to be readily grasped by an operator during use, a central plane extending longitudinally through the handle and defining on opposite sides thereof a first blade-receiving chamber in the first handle portion for receiving a first blade holder and a second blade-receiving chamber in the second handle portion for receiving a second blade holder; and a first blade holder located in the first handle portion for supporting a first blade and a second blade holder located in the second handle portion for supporting a second blade, the blade holders being independently reciprocable in planes parallel with the central plane but on opposite sides thereof, each blade holder having an individual actuator extending to exterior of the handle whereby an operator may move either blade holder or both between a retracted inoperative orientation with an associated blade totally within the handle and an extended operative orientation with an associated blade partially exterior of the handle.

A further object of the invention is to reciprocate a pair of blades of the utility knife independently in parallel planes between interior operative orientations and exterior operative orientations.

A further object of the present invention is to extend the utility of knives having handles adapted to support plural, independent reciprocable blades of different or similar characteristics.

A further object of the present invention is to space opposite handle portions of a utility knife with a spacer plate to function as a bearing surface for blades on opposite sides thereof for independent reciprocation along parallel planes.

A further object of the present invention is to support a pair of blades for movement in parallel planes with the adjacent surfaces of blade holders functioning as bearing surfaces for the blades during their movement together or with respect to each other.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into an improved utility knife comprising, in combination, a handle having a first handle portion and a second handle portion and coupling means to releasably join together the handle portions so as to be readily grasped by an operator during use, a central plane extending longitudinally through the handle and defining on opposite sides thereof a first blade-receiving chamber in the first handle portion for receiving a first blade holder and a second blade-receiving chamber in the second handle portion for receiving a second blade holder; and a first blade holder located in the first handle portion for supporting a first blade and a second blade holder located in the second handle portion for supporting a second blade, the blade holders being independently reciprocable in planes parallel with the central plane but on opposite sides thereof, each blade holder having an individual actuator extending to exterior of the handle whereby an operator may move either blade holder or both between a retracted inoperative orientation with an associated blade totally within the handle and an extended operative orientation with an associated blade partially exterior of the handle.

The utility knife further includes a central handle portion forming part of the handle positionable between the first and second handle portions and provides first and second bearing surfaces for sliding contract with the first and second blade holders respectively during their movement between their operative and inoperative orientations. The utility knife, as an alternative, may include first and second blade holders including first and second bearing surfaces in mutual sliding contact with each other during movement between the operative and inoperative orientations.

The utility knife, has each blade holder with an upper ledge and a lower ledge for supporting a blade therebetween, one of the ledges being formed as an upwardly urged spring coupled to an associated actuator, the spring having a laterally extending projection positionable in one of a plurality of associated recesses in its associated handle portion for locking the blade holder into one of a plurality of orientations. Each spring is formed in a lower ledge. Each actuator has a threaded upper end and an indicia-bearing component threadedly received thereon.

The invention may also be incorporated into an improved utility knife comprising, in combination, a handle having a first handle portion and a second handle portion and a central handle portion and coupling means to releasably join together the handle portions to define elongated upper and lower edges and short front and back edges for being readily grasped by an operator during use, a central plane extending longitudinally through the central handle portion and defining on opposite sides thereof a first blade-receiving chamber in the first handle portion for receiving a first blade holder and a second blade-receiving chamber in the second handle portion for receiving a second blade holder; a first blade and a second blade; and a first blade holder located in the first handle portion supporting the first blade and a second blade holder located in the second handle portion supporting the second blade, the blade holders and supported blades being independently reciprocable in sliding contact with the central handle portion in planes parallel with the central plane but on opposite sides thereof, each blade holder having an individual actuator extending to exterior of the handle whereby an operator may move either blade holder and its supported blade between a retracted inoperative orientation with its supported associated blade within the handle and an extended operative orientation with its supported blade partially exterior of the handle.

The invention may be incorporated into an improved utility knife comprising, in combination, a handle having a first handle portion and a second handle portion and a coupling means to releasably join together the handle portions to define elongated upper and lower edges and short front and back edges for being readily grasped by an operator during use, a central plane extending longitudinally through the central handle portion and defining on opposite sides thereof a first blade-receiving chamber in the first handle portion for receiving a first blade holder and a second blade-receiving chamber in the second handle portion for receiving a second blade holder; a first blade and a second blade; and a first blade holder located in the first handle portion supporting the first blade and a second blade holder located in the second handle portion supporting the second blade, bearing surfaces formed in each blade holder at adjacent surfaces, the blade holders blades being independently reciprocable with their adjacent surfaces in sliding contact with the central plane but on opposite sides thereof, each blade holder having an individual actuator extending to exterior of the handle whereby an operator may move either blade holder and its supported blade between a retracted inoperative orientation with its supported associated blade totally within the handle and an extended operative orientation with its supported blade partially exterior of the handle.

Lastly, the invention may be incorporated into a device, for use in association with handle halves of a conventional utility knife for retractable, single-blade type, a central handle portion having a longitudinal, shallow bearing surface formed in a first face against which one knife may reciprocate in a first plane, the central handle portion having a second elongated, deep bearing surface formed in the face opposite the first face against which a second knife may reciprocate in a second plane, parallel with the first plane, and an aperture through the central extent of the central housing portion for the passage of an elongated coupling screw.

The foregoing has outlined rather broadly, the more pertinent and important features of the present invention. The detailed description of the invention that follows is offered so that the present contribution to the art may be more fully appreciated, Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several Figures.

DETAILED DESCRIPTION OF THE PREFERRED EMBODIMENT OF THE INVENTION

Figure 1:
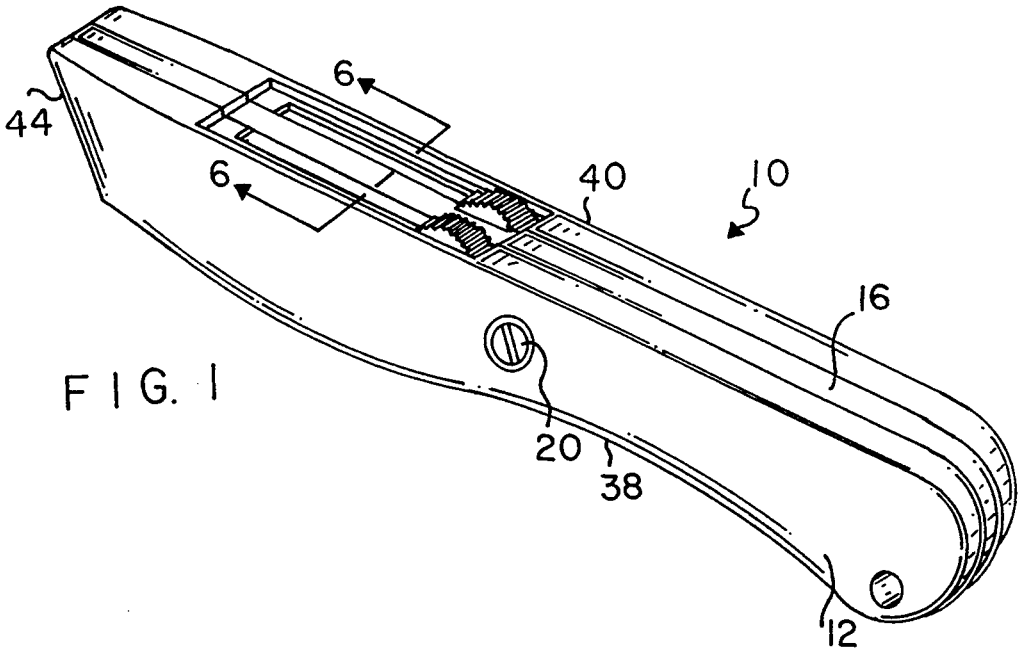
FIG. 1 is a perspective view of a utility knife constructed in accordance with the primary embodiment of the present invention.
Figure 2:
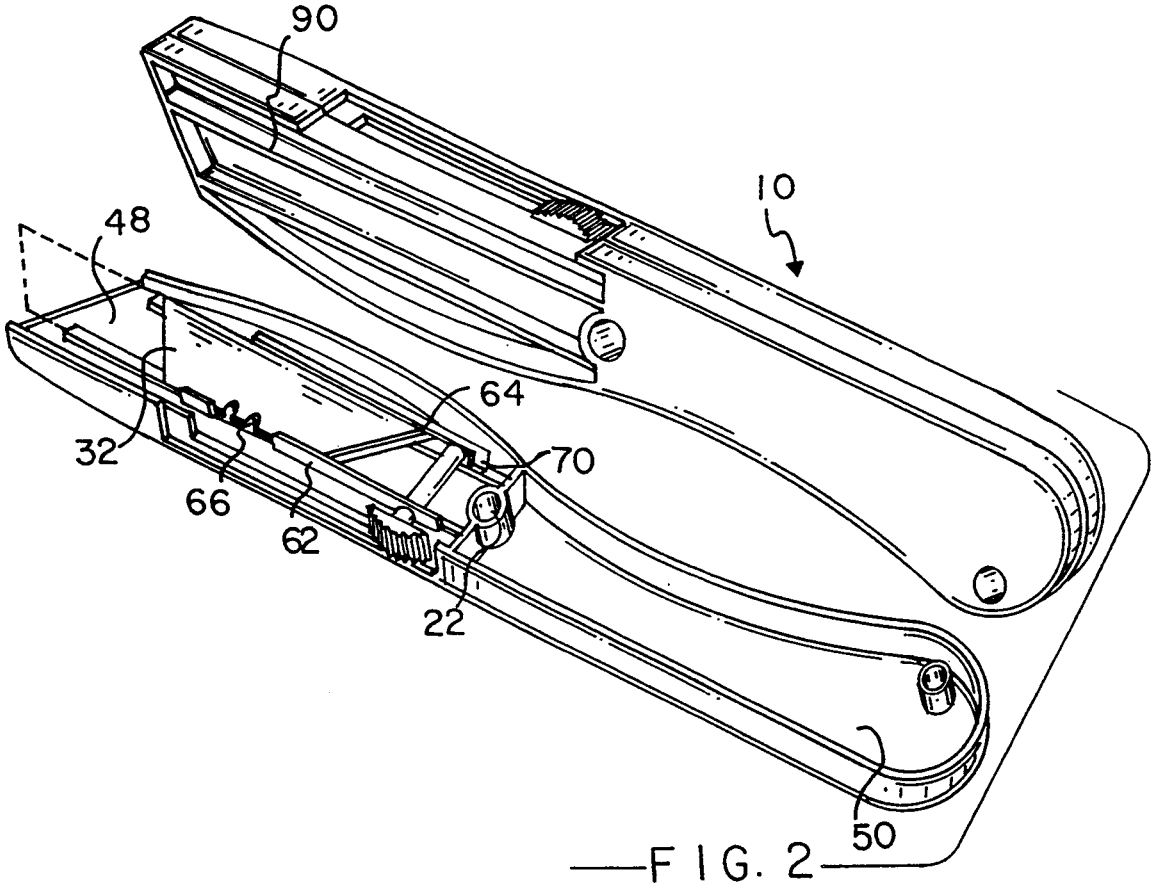
FIG. 2 is a perspective view similar to FIG. 1 but with one of the handle portions removed to show certain internal constructions thereof.
Figure 3:
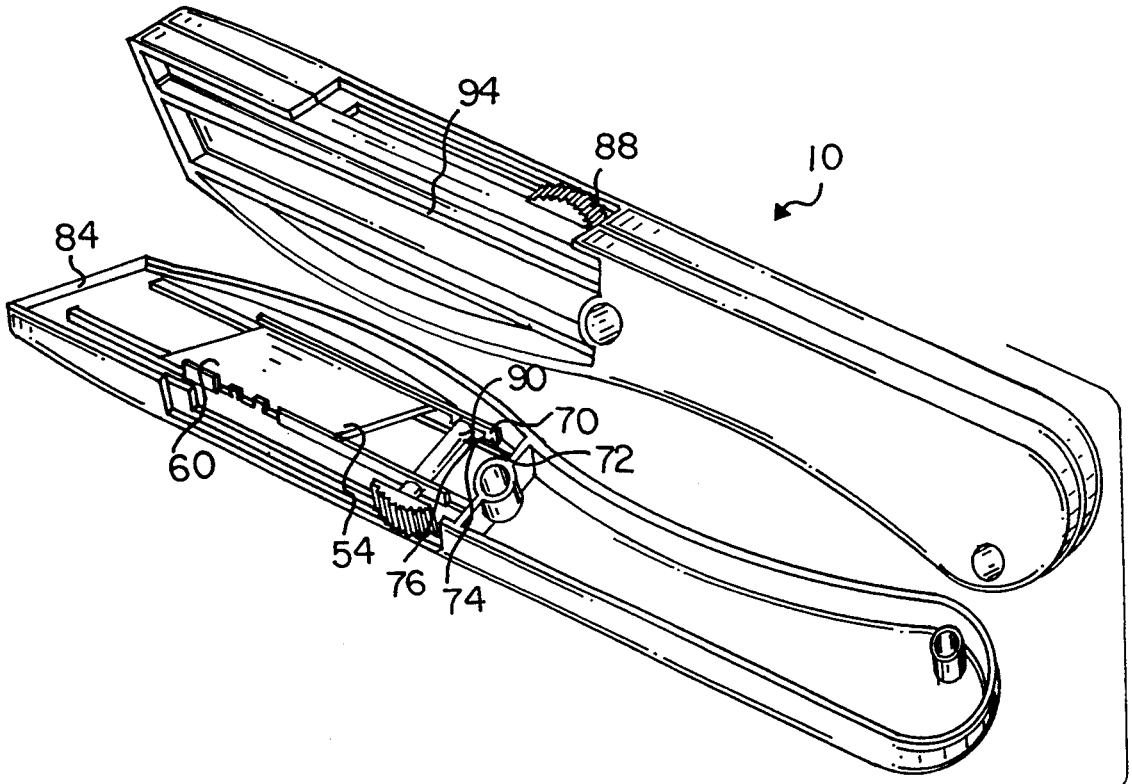
FIG. 3 is a view similar to FIG. 2 but with the knife blade removed to show further internal constructions thereof.
Figure 4:
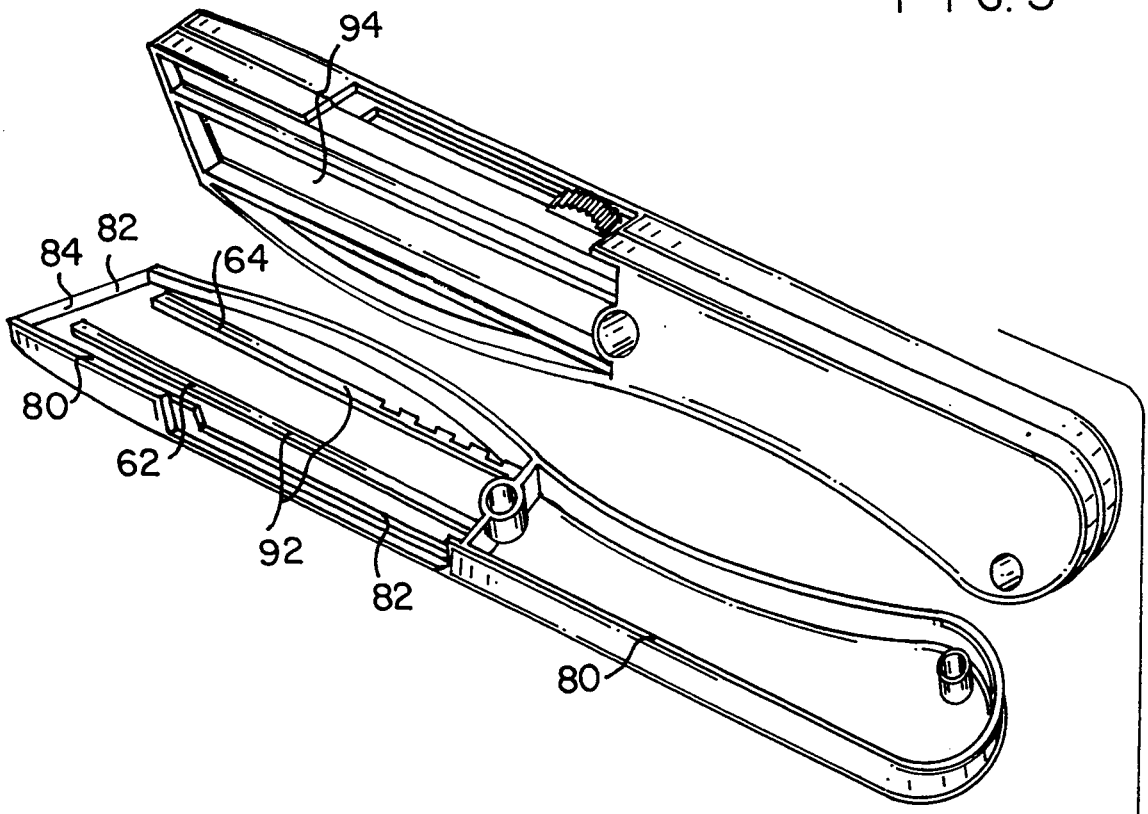
FIG. 4 is a view similar to FIG. 3 but with the blade holder removed.
Figure 5:
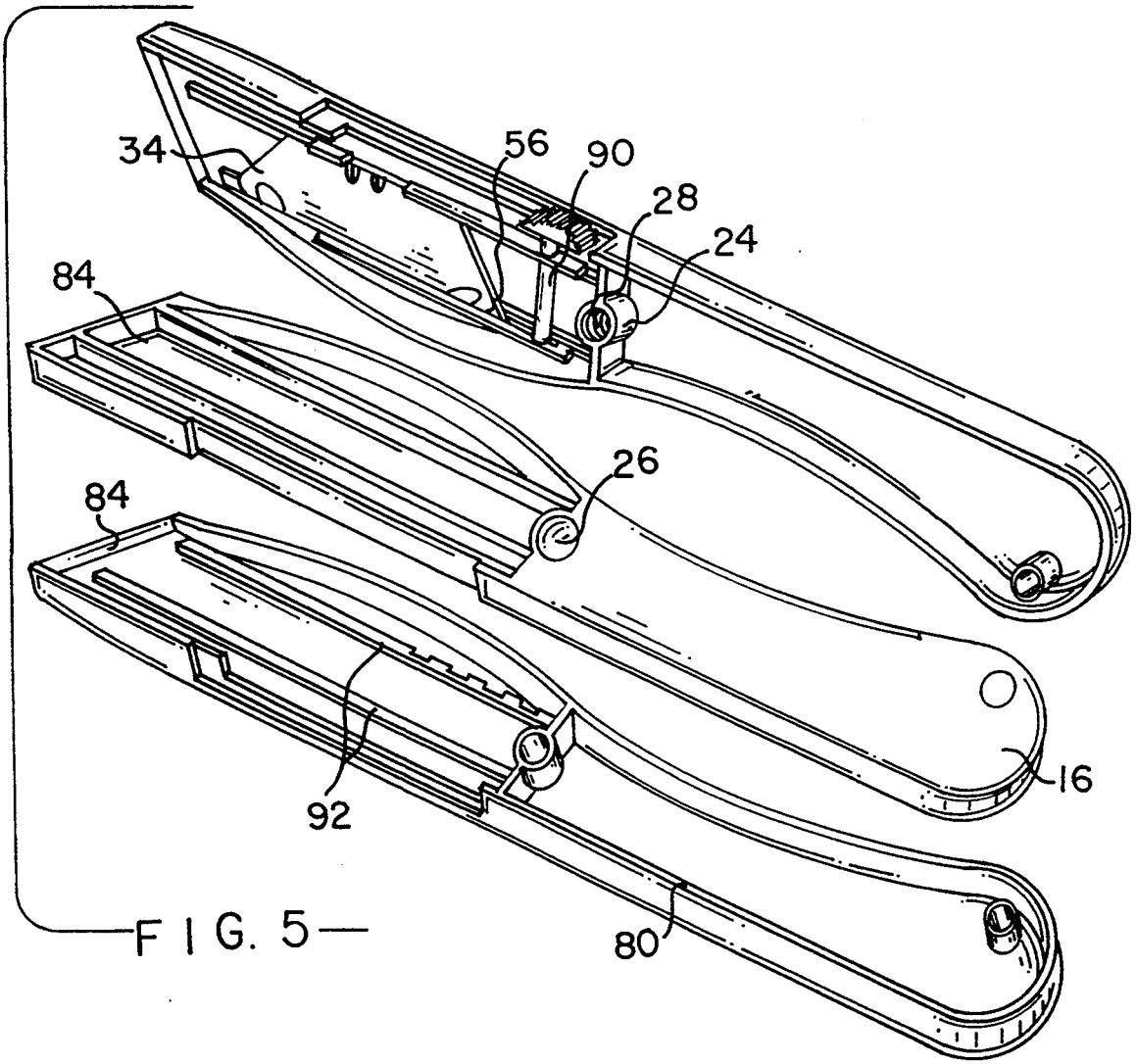
FIG. 5 is a view similar to FIG. 4 but with the central portion thereof removed.
Figure 6:
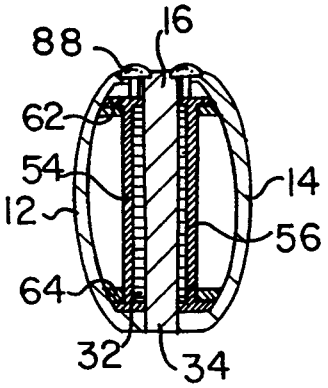
FIG. 6 is a sectional view of the assembled knife of FIG. 1 taken along line 6—6 of FIG. 1.

As shown in the Figures, with particular reference to FIGS. 1 through 6, there is shown a utility knife 10 constructed in accordance with the primary embodiment of the present invention, As can be readily seen in FIG. 1, a perspective view of the entire knife when assembled and ready for use, the knife includes a first and second handle portion 12 and 14 and a central handle portion 16 positionable therebetween. The first and second handle portions are of a similar construction in that they are essentially mirror images of each other. A bolt 20 extends through aligned apertures 22, 24 and 26 in the first and second handle portions and the central handle portions. The bolt has threads matable with threads 28 formed in the aperture of one of the handle portions. Initially inserting the bolt through the apertures 22, 24 and 26 of the first handle portion and central handle portion into engagement with the threads 28 of the second handle portion allows for the proper coupling of the blades as shown in FIG. 1. Unthreading of the screw and its removal allows for separation of the handle portions as shown in FIGS. 2 through 5. This permits a user to exchange the blades 32, 34, etc., to replace a worn blade or to utilize blades of different designs such as the straight angled blade 32 of FIG. 2 or the hook blade 34 of FIG. 5.

The particular contour, shape and design of the exterior surfaces of the handle, when assembled, allows for the convenient holding of the handle and utility knife during use. Such shape includes a bottom edge 38 and top edge 40 through which knife movement is controlled and a back edge 42 and front edge 44 with an opening through which the blades may move.

As can be seen in FIGS. 2 through 5, both the first and second handle portions are provided with chambers 48 and 50. The forwarded chamber 48 adjacent the front edge 44 of each of the first and second handle portions is sized and positioned for receiving its associated blade holder 54 and 56 and supported blade. The rearward cheer 50 adjacent the back edge 42 of the knife of the first and second handle portions is for receiving and storing a quantity of supplemental blades of similar or common designs. This arrangement is generally conventional in the art of utility knives.

The two blade holders 54 and 56 are of a similar construction but are mirror images of each other. Each blade holder includes a planar section 60, in a plane parallel with, but offset from, its associated knife. At the upper and lower edges of the blade holder are ledges 62 and 64 to receive and support the upper and lower edges of the blade to be utilized. A downwardly turned notch 66 in the upper ledge allows for conventional coupling of the knife with respect to its holder as it is advanced longitudinally in the plane of the knife and knife holder.

Centrally located between the planes of movement of the knives and knife holders is the central plane of the utility knife. The central plane extends centrally along the entire length of the central portion of the handle. The ledge has a rearward component which is an upwardly biased spring 70 and allows an outwardly directed projection 72 to selectively lodge in one of a plurality of recesses 74 formed in an intermediate ledge 76 of its associated handle portion. In this manner, the blade and blade holder may be locked in the inoperative position interior of the handle for safety when not in use. The blade and blade holder may also be advanced and locked in the remaining recesses in any of a plurality of advanced or operative positions with the blade extending forwardly at the front end of the blade for operation and use in cutting objects.

The periphery of the first and second handle portions are provided with ledges of the greatest height to contact associated portions of the central handle portion. Such ledges extend around the entire periphery of the first and second handle portions except the front edge where the ledges are shorter ledges 82 which forms apertures 84 through which the blades may be advanced or retracted. The shorter ledges are also recessed along the upper end for allowing the passage of the operator controlled actuators or buttons 88 at the upper end of the posts 90 coupled to the springs 70 to allow for movement of the blades and blade holders when the buttons 88 are depressed to release the projections 72 from a recesses 74. Linear ledges 92 of intermediate height are also provided centrally of the housing portions to act as bearing surfaces for the reciprocating knife holders. The ledges and knives reciprocate against adjacent, bearing surfaces 94 of the central handle portion 16 which functions as a cooperative bearing surface.

Figure 9:
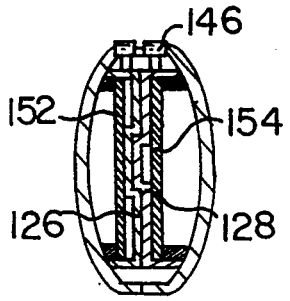
FIG. 9 is a sectional view taken through line 9—9 of FIG. 7.
Figure 7:
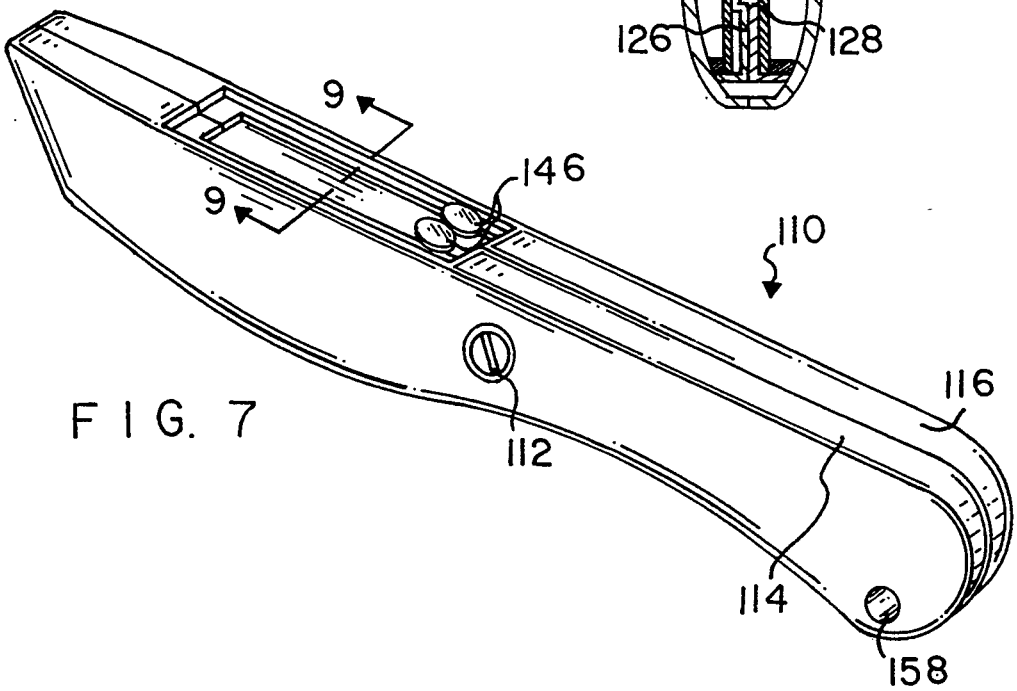
FIG. 7 is a perspective view of a utility knife constructed in accordance with an alternate embodiment of the present invention.
Figure 8:
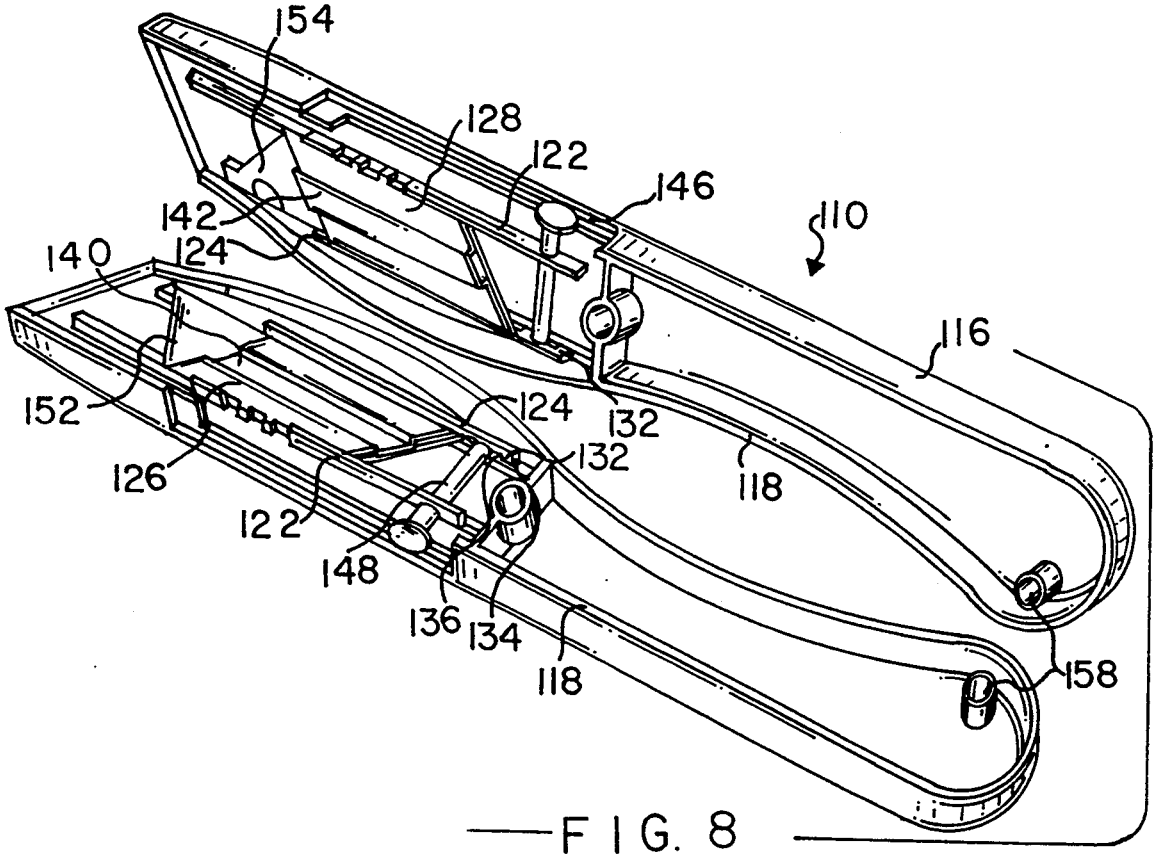
FIG. 8 is a view similar to FIG. 7 but with two halves of the knife separated.

An alternate embodiment of the invention can be seen in FIGS. 7 through 9. In accordance with the alternate embodiment, the knife 110 is formed with a handle formed of two handle portions 114 and 116 coupled by a bolt 112 but no central portion. The peripheral ledges 118 of each knife portion thus directly contact one another. In most regards, the handle portions are of a mirror image construction, similar to those of the primary embodiment, each with upper and lower ledges 122 and 124 on a blade holder 126 and 128 and a spring 132. The spring includes a projection 134 positionable in any of a plurality of recesses 136 for locking the knife in a desired orientation. The interior adjacent faces of the blade holders, however, are formed with surfaces to preclude undesired elevational motion with respect to each other but to allow longitudinal reciprocation together or with respect to each other.

The preferred shape of the bearing surfaces of the blade holders includes a central longitudinal recess 140 in one of the blade holders and a central longitudinal projection 142 in the other of the blade holders. This allows for three vertical surfaces and two horizontal surfaces to be in a sliding contact with each other. In this manner, the central handle portion with its bearing surfaces as provided in the first embodiment may be eliminated.

A last feature of the alternate embodiment is the construction of the actuator or button 146 and post 148. The upper end of the post is provided with threads cooperable with a central threaded aperture in the buttons. In this manner, buttons with varying color, words, or other indicia may be utilized to indicate the type of blade 152 and 154 controlled by such button. Such buttons and posts may be also be utilized in the primary embodiment. Similarly, apertures 158 in the handle portions adjacent to the back end may allow for coupling of the knife to the user, clothing of the user, or the like through a string extending through the aperture, another generally conventional feature.

Figure 10:
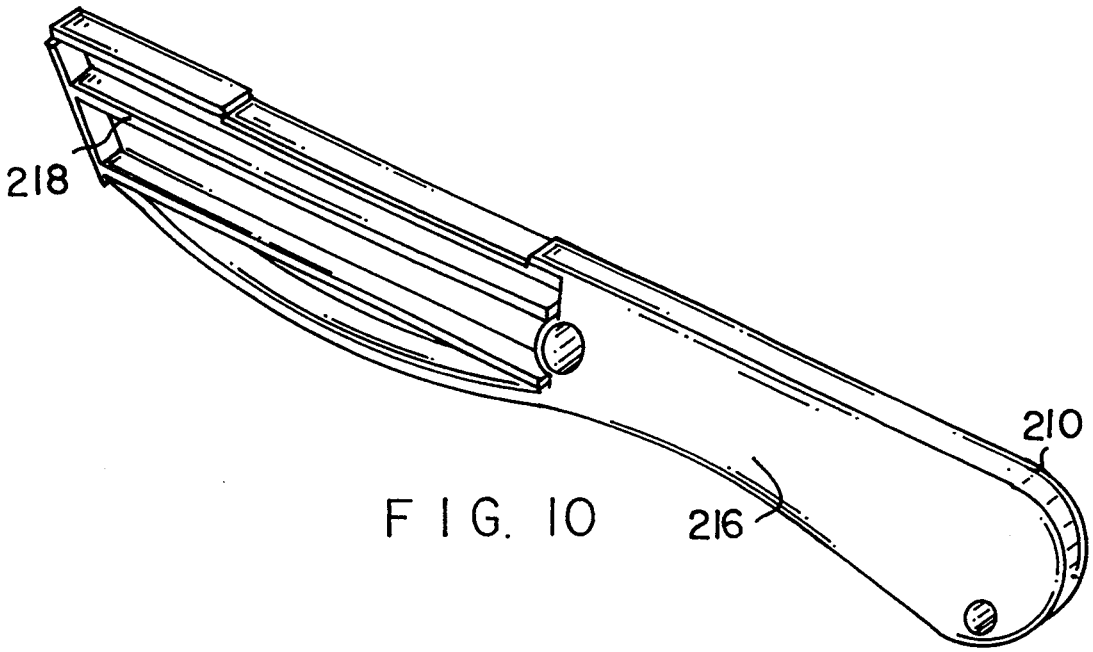
FIGS. 10 through 12 illustrate a further alternate embodiment of the present invention.
Figure 11:
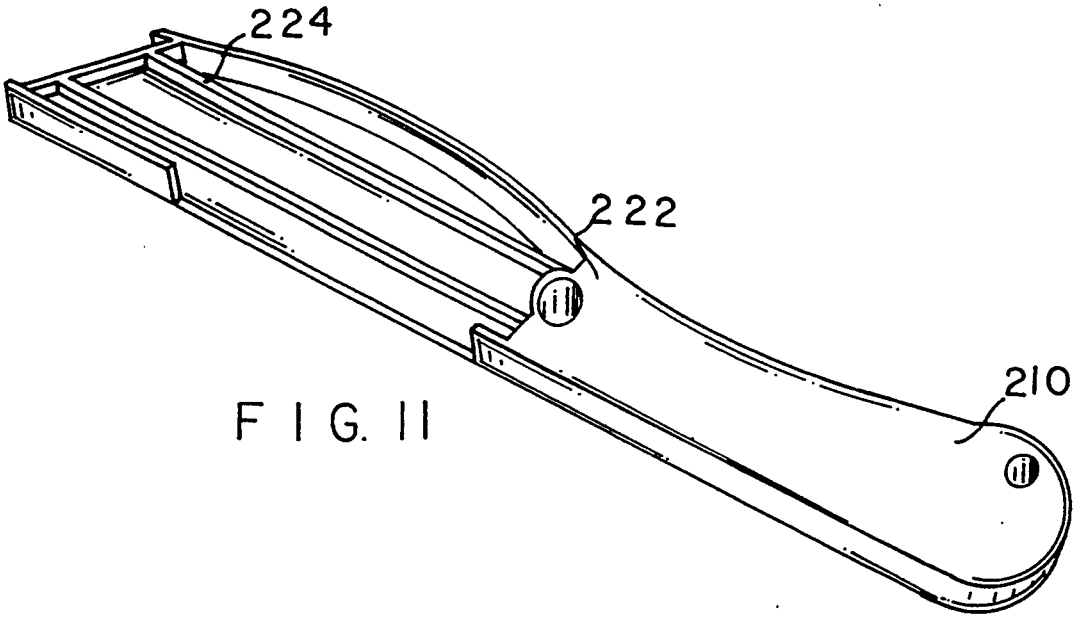
Figure 12:
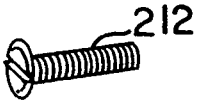

A further alternate embodiment of the invention is shown in FIGS. 10 through 12. This embodiment relates to a center handle portion 210 adapted to be used with conventional utility knives of the retractable, single-blade type. FIGS. 10 and 11 show the opposite sides of the central handle portion. FIG. 12 shows an elongated bolt 212 necessitated by the extra thickness of the handle when the center handle portion 210 is used intermediate the handle halves of a conventional utility knife.

More specifically, conventional handle halves of utility knives are similar to each other with the principal difference being that the front edge of only one half, the first half, is formed with recess for passage of a blade. The other half, the second half, has no recess for blade passage. Consequently, the first face 216 of the center portion 210 facing the first handle half is provided with a shallow elongated recess for constituting a first bearing surface 218 against which the sliding first blade may move. It has an interior configuration corresponding to the interior configuration of the second half of the conventional handle. Conversely, the second face 222 of the center portion 210 facing the second handle portion is provided in its front half with a deep elongated recess for receiving a blade and blade holder and constituting a bearing surface 224 against which the sliding second blade may move. The elongated second recess has a configuration corresponding to the interior configuration of the first half of the conventional handle.

Although not shown, the first half of the conventional handle would house a blade and a conventional blade holder, not shown, while the second half of the conventional handle would house an identical blade holder. The blades, of course, would also be of a conventional design.

The present disclosure includes that contained in the appended claims as well as that of the foregoing description. Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

Now that the invention has been described, what is claimed is:

1. A utility knife comprising, in combination:

a handle having a first handle portion and a second handle portion and coupling means to releasably join together the handle portions so as to be readily grasped by an operator during use, a central plane extending longitudinally through the handle and defining on opposite sides thereof a first blade-receiving chamber in the first handle portion for receiving a first blade holder and a second blade-receiving chamber in the second handle portion for receiving a second blade holder; and a first blade holder located in the first handle portion for supporting a first blade and a second blade holder located in the second handle portion for supporting a second blade, the blade holders being independently reciprocable in planes parallel with the central plane but on opposite sides thereof, each blade holder having an individual actuator extending to exterior of the handle whereby an operator may move either blade holder or both between a retracted inoperative orientation with an associated blade totally within the handle and an extended operative orientation with an associated blade partially exterior of the handle.

2. The utility knife as set forth in claim 1 and further including a central handle portion forming part of the handle positionable between the first and second handle portions and providing first and second bearing surfaces for sliding contact with the first and second blade holders respectively during their movement between their operative and inoperative orientations.

3. The utility knife as set forth in claim 1 wherein the first and second blade holders include first and second bearing surfaces in mutual sliding contact with each other during movement between the operative and inoperative orientations.

4. The utility knife as set forth in claim 1 wherein each blade holder has an upper ledge and a lower ledge for supporting a blade therebetween, one of the ledges being formed as an upwardly urged spring coupled to an associated actuator, the spring having a laterally extending projection positionable in one of a plurality of associated recesses in its associated handle portion for locking the blade holder into one of a plurality of orientations.

5. The utility knife as set forth in claim 4 wherein each spring is formed in a lower ledge.

6. The utility knife as set forth in claim 4 wherein each actuator has a threaded upper end and an indicia-bearing component threadedly received thereon.

7. A utility knife comprising, in combination:

a handle having a first handle portion and a second handle portion and a central handle portion and coupling means to releasably join together the handle portions to define elongated upper and lower edges and short front and back edges for being readily grasped by an operator during use, a central plane extending longitudinally through the central handle portion and defining on opposite sides thereof a first blade-receiving chamber in the first handle portion for receiving a first blade holder and a second blade-receiving chamber in the second handle portion for receiving a second blade holder;

a first blade and a second blade; and a first blade holder located in the first handle portion supporting the first blade and a second blade holder located in the second handle portion supporting the second blade, the blade holders and supported blades being independently reciprocable in sliding contact with the central handle portion in planes parallel with the central plane but on opposite sides thereof, each blade holder having an individual actuator extending to exterior of the handle whereby an operator may move either blade holder and its supported blade between a retracted inoperative orientation with its supported associated blade within the handle and an extended operative orientation with its supported blade partially exterior of the handle.

8. A utility knife comprising, in combination:

a handle having a first handle portion and a second handle portion and a coupling means to releasably join together the handle portions to define elongated upper and lower edges and short front and back edges for being readily grasped by an operator during use, a central plane extending longitudinally through the central handle portion and defining on opposite sides thereof a first blade-receiving chamber in the first handle portion for receiving a first blade holder and a second blade-receiving chamber in the second handle portion for receiving a second blade holder;

a first blade and a second blade; and a first blade holder located in the first handle portion supporting the first blade and a second blade holder located in the second handle portion supporting the second blade, bearing surfaces formed in each blade holder at adjacent surfaces, the first blade holder and the second blade holder being independently reciprocable with their adjacent surfaces in sliding contact with the central plane but on opposite sides thereof, each blade holder having an individual actuator extending to exterior of the handle whereby an operator may move either blade holder and its supported blade between a retracted inoperative orientation with its supported associated blade totally within the handle and an extended operative orientation with its supported blade partially exterior of the handle.

9. A conventional utility knife of the type having separable handle halves and a single retractable conventional blade, the improvement comprising a supplemental blade and a central handle portion having a first longitudinal, shallow bearing surface formed in a first face and first means for independently reciprocating the one conventional blade against said first surface in a first plane, the central handle portion having a second elongated, deep bearing surface formed in the face opposite the first face and second means for independently reciprocating the supplemental blade against said second surface in a second plane, parallel with the first plane, and an aperture through the central extent of the central handle portion for the passage of an elongated coupling screw.

10. The improved utility knife as set forth in claim 9 wherein each blade is independently reciprocated between an exposed operative orientation and a non exposed inoperative orientation between the central handle portion and the respective one of said separable handle halves.

* * * * *